US011375774B2

(12) United States Patent
Durrell et al.

(10) Patent No.: US 11,375,774 B2
(45) Date of Patent: Jul. 5, 2022

(54) KNITTED COMPONENT HAVING A KNITTED ANCHOR PORTION

(71) Applicant: NIKE, Inc., Beaverton, OR (US)

(72) Inventors: Dalton T. Durrell, Portland, OR (US); Chaokun Huangfu, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 185 days.

(21) Appl. No.: 16/534,702

(22) Filed: Aug. 7, 2019

(65) Prior Publication Data

US 2020/0046078 A1 Feb. 13, 2020

Related U.S. Application Data

(60) Provisional application No. 62/716,794, filed on Aug. 9, 2018.

(51) Int. Cl.

| | |
|---|---|
| ***A43C 1/04*** | (2006.01) |
| ***A43B 23/02*** | (2006.01) |
| ***A43C 1/06*** | (2006.01) |
| ***D04B 1/22*** | (2006.01) |
| ***D04B 1/24*** | (2006.01) |

(52) U.S. Cl.

CPC ..... *A43C 1/04* (2013.01); *A43B 23/02* (2013.01); *A43C 1/06* (2013.01); *D04B 1/225* (2013.01); *D04B 1/24* (2013.01); *D10B 2501/043* (2013.01)

(58) Field of Classification Search

CPC .. A43C 1/06; A43B 1/06; D04B 1/225; D04B 1/123

USPC ..... 66/190

See application file for complete search history.

(56) References Cited

U.S. PATENT DOCUMENTS

| | | | | |
|---|---|---|---|---|
| 4,553,342 | A | 11/1985 | Derderian et al. | |
| 8,132,340 | B2 * | 3/2012 | Meschter | A43C 5/00 36/45 |
| 8,418,380 | B2 * | 4/2013 | Dojan | A43B 5/06 36/45 |
| 8,745,896 | B2 | 6/2014 | Dua et al. | |
| 8,756,833 | B2 | 6/2014 | Heard | |
| 8,769,844 | B2 | 7/2014 | Beers et al. | |
| 8,844,168 | B2 | 9/2014 | Toraya | |

(Continued)

FOREIGN PATENT DOCUMENTS

| | | |
|---|---|---|
| CN | 104337123 A | 2/2015 |
| CN | 108125314 A | 6/2018 |

(Continued)

OTHER PUBLICATIONS

International Search Report and Written Opinion dated Nov. 22, 2019 for PCT Application No. PCT/US2019/045844, 21 pages.

(Continued)

*Primary Examiner* — Sharon M Prange
*Assistant Examiner* — Grace Huang
(74) *Attorney, Agent, or Firm* — Shook, Hardy and Bacon L.L.P.

(57) ABSTRACT

A knitted component may include an adjustable tensioning cable, may form at least a portion of an exterior surface of an upper, and may include at least one knit anchor having a channel for receiving the tensioning cable, where the tensioning cable extends through the channel, and where the channel of the at least one anchor extends along an arc.

9 Claims, 9 Drawing Sheets

(56) References Cited

U.S. PATENT DOCUMENTS

| | | | | |
|---|---|---|---|---|
| 8,881,430 | B2 * | 11/2014 | Seamarks | A43B 23/0235 36/45 |
| 8,973,410 | B1 * | 3/2015 | Podhajny | A43B 23/04 66/177 |
| 9,192,204 | B1 * | 11/2015 | Liles | A43B 23/0245 |
| 9,241,537 | B2 * | 1/2016 | Beye | A43B 23/025 |
| 9,392,835 | B2 * | 7/2016 | Dekovic | D04B 1/104 |
| 9,404,205 | B2 | 8/2016 | Meir | |
| 9,661,892 | B2 * | 5/2017 | Meir | D04B 1/108 |
| 9,681,704 | B2 * | 6/2017 | Podhajny | A43B 23/042 |
| 9,693,605 | B2 | 7/2017 | Beers | |
| 9,700,101 | B2 * | 7/2017 | Lovett | A43C 3/02 |
| 11,122,850 | B2 * | 9/2021 | Hutchinson | A43B 23/027 |
| 11,122,863 | B2 * | 9/2021 | Meir | A43B 23/0245 |
| 2010/0154256 | A1 | 6/2010 | Dua | |
| 2011/0041359 | A1 | 2/2011 | Dojan et al. | |
| 2012/0234051 | A1 | 9/2012 | Huffa | |
| 2018/0020767 | A1 | 1/2018 | Dyer et al. | |
| 2018/0035759 | A1 | 2/2018 | Pollack et al. | |
| 2020/0048800 | A1 * | 2/2020 | McFarland, II | D04B 1/12 |
| 2020/0187595 | A1 | 6/2020 | Siegismund et al. | |
| 2020/0240054 | A1 * | 7/2020 | Schoppel | D06C 23/02 |
| 2021/0030117 | A1 * | 2/2021 | Frazier | A43B 5/001 |

FOREIGN PATENT DOCUMENTS

| | | | | |
|---|---|---|---|---|
| WO | WO 2015/038448 | A2 | 3/2015 | |
| WO | WO 2015/038448 | A3 | 3/2015 | |
| WO | WO 2016/033051 | A1 | 3/2016 | |
| WO | WO-2020244884 | A1 * | 12/2020 | D04B 1/123 |

OTHER PUBLICATIONS

International Preliminary Examination Report on Patentability received for PCT Application No. PCT/US2019/045844, dated Feb. 18, 2021, 11 pages.

* cited by examiner

KNITTED COMPONENT HAVING A KNITTED ANCHOR PORTION

RELATED APPLICATION

This application claims the benefit of U.S. Provisional Application No. 62/716,794, filed Aug. 9, 2018, which is hereby incorporated by reference in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure. Moreover, in the figures, like referenced numerals designate.

DETAILED DESCRIPTION

Figure 1:
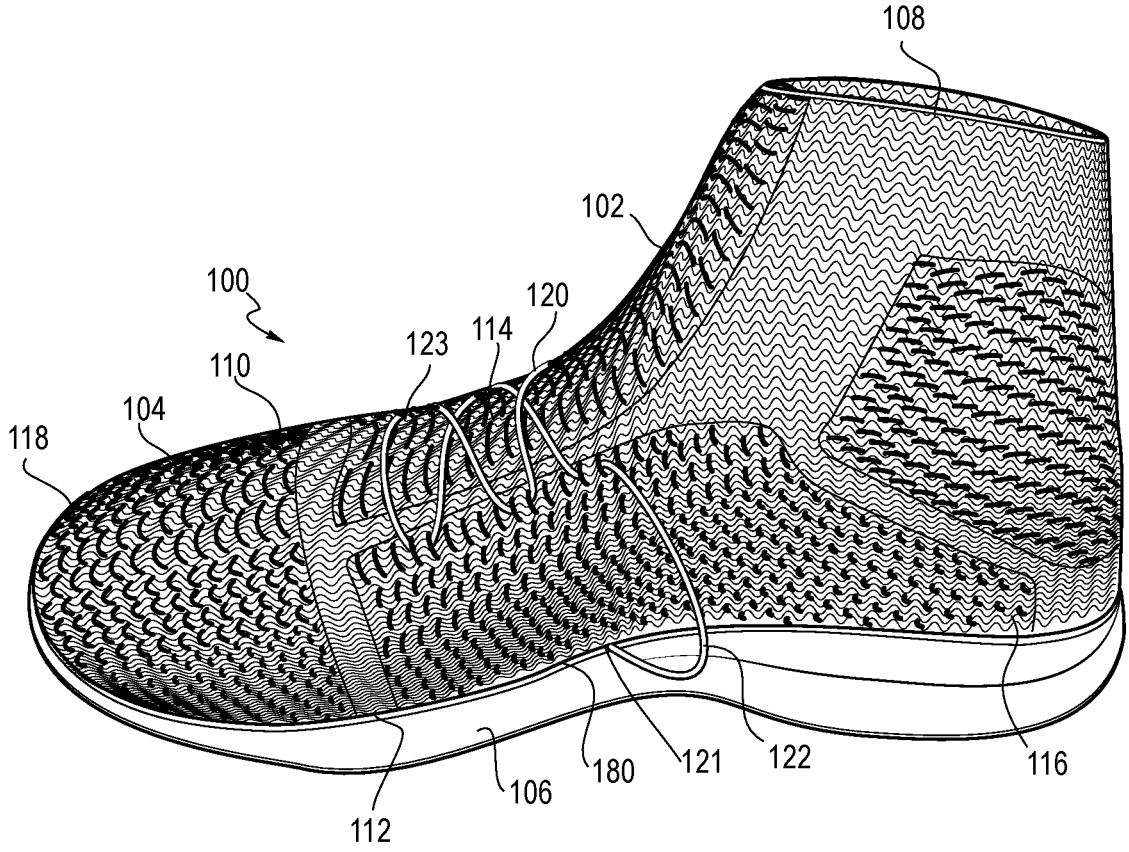
FIG. 1 is a photograph showing an article of footwear incorporating a tensioning system with a knit anchor in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

In one aspect, a knitted component (which may be included in an article of apparel, an upper for an article of footwear or another article) may include an adjustable tensioning cable and a knitted component forming at least a portion of an exterior surface of the upper (or other article). The knitted component may include at least one knit anchor having an channel for receiving the tensioning cable, where the tensioning cable extends through the channel, and where the channel of the at least one anchor extends along an arc. In some aspects, the arc may be oriented towards a throat area of the upper.

In another aspect, a tensioning system may include a tensioning cable and a knitted component that comprises at least one knit anchor having an channel for receiving the tensioning cable, where the tensioning cable extends through the channel, and wherein the channel of the at least one anchor extends along an arc.

In another aspect, a tensioning system may include a tensioning cable and a knitted component having a knit element and at least three inlaid strands that are inlaid within the knit element. The at least three inlaid strands each have an exposed portion that is exposed on a surface of the knit element, where a channel is defined between the exposed portions of the at least three inlaid strands and the surface of the knit element, and where the tensioning cable extends through the channel.

FIG. 1 is an illustration showing an article of footwear 100 having an upper 102, where the upper 102. The upper 102 may be formed as any suitable type of textile (e.g., a woven or non-woven textile) or another suitable material, and in some embodiments the textile(s) may be formed as a knitted component 104 through the mechanical manipulation of yarns (as described in more detail below).

The upper 102 may be secured to a sole structure 106. The area where the sole structure 106 joins the upper 102 may be referred to as a biteline 180. The upper 102 may be joined to the sole structure 106 in a fixed manner using any suitable technique, such as through the use of an adhesive, by sewing, etc. The sole structure 106 may define the bottom surface of a void for receiving and accommodating a user's foot. The void may be accessible through an ankle opening 108.

The upper 102 may include a lateral side 110 and a medial side 112. A throat area 114 may be included between the lateral side 110 and the medial side 112, and the throat area 114 may be positioned to cover the top (dorsal) surface of the foot during typical use. A midfoot area 121 of the upper 102 may be located between a heel area 116 and a toe area 118. The throat area 114 may be primarily located in the midfoot area 121. In some embodiments, an optional tongue may be disposed at least partially in the throat area 114. The tongue may be any type of tongue, such as a gusseted tongue or a burrito tongue. If a tongue is not included (or in combination with a tongue), the lateral and medial sides of the throat area 114 may be joined together.

As stated above, at least a portion of the upper 102 may be formed with a knitted component (or another suitable textile component). For example, the upper 102 may be formed primarily as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted components without the need for significant post-knitting processes or steps. Alternatively, the knitted component 104 may be formed separately as distinct integral one-piece elements and then the respective elements attached (e.g., via sewing).

Forming the upper with a knitted component 104 may impart advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The weight of the upper 102, and thus the overall weight of the article of footwear 100, may be reduced with respect to alternative components typically used in footwear. The component 104 may also provide desirable aesthetic characteristics by incorporating yarns having different colors, textures or other visual properties arranged in a particular pattern. The yarns themselves and/or the knit structure formed by one or more of the yarns of the knitted components may be varied at different locations to provide different knit portions with different properties (e.g., a portion forming the throat area 114 of the first knitted component 104 may be relatively elastic while a portion forming the heel area 116 or another area may be relatively inelastic).

In some embodiments, the first knitted component 104 may incorporate one or more materials with properties that change in response to a stimulus (e.g., temperature, moisture, electrical current, magnetic field, or light). For example, as described in more detail below, the first knitted component 104 may include yarns formed of a thermoplastic polymer material (e.g., a polyurethane, polyamide, polyolefin, and/or nylon) that transitions from a solid state to a softened or liquid state when subjected to certain temperatures at or above its melting point and then transitions back to the solid state when cooled. The thermoplastic polymer material may provide the ability to heat and then cool a portion of the first knitted component 104 to thereby form an area of bonded or continuous material (herein referred to as a "fused area") that exhibits certain advantageous properties including a relatively high degree of rigidity, strength, and water resistance, for example.

In some embodiments, the lacing pattern of the article of footwear 100 may include a tensioning system 120 to move the upper 102 between a loosened state and a tightened state (e.g., to adjust the geometry of upper 102 to tighten the upper 102 around the foot of a user). In some embodiments, the tensioning system 120 may be a shoelace. In other embodiments, the tensioning system 120 may be a more advanced system involving at least one adjustable (e.g., movable) tensioning cable 122 that extends through a series of anchors 123 coupled to (or part of) the upper 102, along with a device used for applying a tension force to at least a portion of the tensioning cable 122 to thereby cause the upper 102 to move into its tightened state. For example, certain examples of tensioning systems that may be used are described in U.S. patent application Ser. No. 15/655,769, filed on Jul. 20, 2017, and entitled "DYNAMIC LACING SYSTEM," which is hereby incorporated by reference in its entirety.

The tensioning cable 122 may be highly lubricious such that the total friction force (i.e., static friction force) between the tensioning cable 122 and the anchors 123 is low enough that a user (or tightening device) can effectively tighten the upper 102 by applying a tension force to the tensioning cable 122 (e.g., lower than about 15 pounds, such as lower than about 5 pounds in certain exemplary embodiments), but high enough such that device does not unintentionally loosen. Further, the tensioning cable 122 may have a low modulus of elasticity and a high tensile strength such that it is substantially non-extensible (e.g., due to formation from one or more fibers having a low modulus of elasticity and/or a high tensile strength). For instance, the fibers/strands forming the tensioning cable 122 may include high modulus polyethylene fibers having a high strength-to-weight ratio and a low elasticity. Additionally or alternatively, the tensioning cable 122 may be formed from a molded monofilament polymer and/or a woven steel (and/or other metal) with or without other lubrication coating. In some examples, the tensioning cable 122 includes multiple strands of material woven together.

Figure 2:
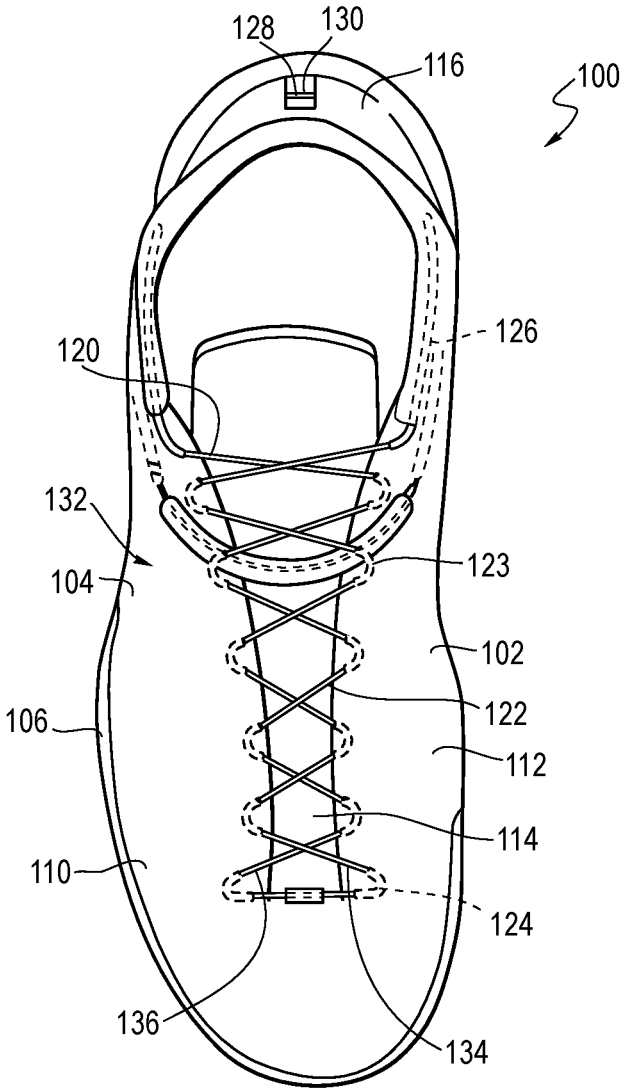
FIG. 2 is an illustration showing a top view of an article of footwear incorporating a tensioning system with a knit anchor in accordance with certain aspects of the present disclosure.

FIG. 2 shows a top view of the article of footwear 100 having a similar tensioning system 120. The tensioning cable 122 may be routed through various openings or channels 124 formed by the upper 102 (and/or the sole structure 106). For instance, in the ankle or heel area 116, the lateral side 110 and/or the medial side 112 of the upper 102 may include a passage 126 between an interior surface and an exterior surface of the knitted component 104 for guiding portions of the tensioning cable 122 to another location, such as to the location 128 in the heel area 116. The passage 126 may be formed by knitting a tubular structure (as described in more detail below), for example. The location 128 may provide an exposed portion 130 of the tensioning cable 122 (or element coupled to the tensioning cable 122) to provide an interface to a user for tightening the tensioning system 120, which is described in detail in in U.S. patent application Ser. No. 15/655,769 (incorporated by reference above).

The anchors 123 with the channels 124 for receipt of the tensioning cable 122 may be formed with particular knit structures (e.g., tubular structures or exposed inlaid strands) of the knitted component 104. The anchors 123 may be located where the tensioning cable 122 changes directions, for example in the throat area 114 and/or along the medial side 112 and lateral sides 110 of the upper 102. The anchors 123 may be located on an exterior surface 132 of the knitted component 104. The tensioning cable 122 may be routed through anchors 123. For instance, the tensioning cable 122 may alternate across the throat area 114 in a zig-zag pattern such that a first portion 134 of the tensioning cable 122 and a second portion 136 of the tensioning cable 122 each communicate with both the lateral and medial sides of the throat area 114. In this configuration, tightening the tensioning cable 122 will cause the lateral and medial sides of the throat area 114 to be pulled together, thus tightening the upper 102 around the foot (or otherwise changing the upper's geometry).

In some embodiments, the anchors 123 may be formed with knit structures. That is, the anchors 123 may be fully formed with the remainder of the knitted component 104 without the need for attaching separate anchor components after the knitting process. For example, the anchors 123 may be formed with a knitted channel (e.g., a curved channel) formed with a tubular knit structure (as described in more detail below), a specific pattern/orientation of exposed portions of inlaid strands (also as described in more detail below), and/or any other suitable knit structure. Advantageously, forming the knit anchors 123 with knit structures of the knitted component 104 may provide the knit anchors 123 with enhanced durability relative to other embodiments since no adhesive, sewn seams, etc. are needed. Further, including the knit anchors 123 as integral parts of the knitted component 104 may enhance the ability for distributing forces through the knitted component 104 in a particular engineered manner. Further, including the knit anchors 123 during the knitting process may save manufacturing steps (e.g., a post-knit attachment step), thus increasing manufacturing efficiency and decreasing the types of materials needed (such as adhesives). Alternatively, the anchors 123 could be formed of non-knit components (e.g., plastic or metal components with associated openings), or separately-knitted components, that are secured to the knitted component 104 after the knitting process.

Figure 3:
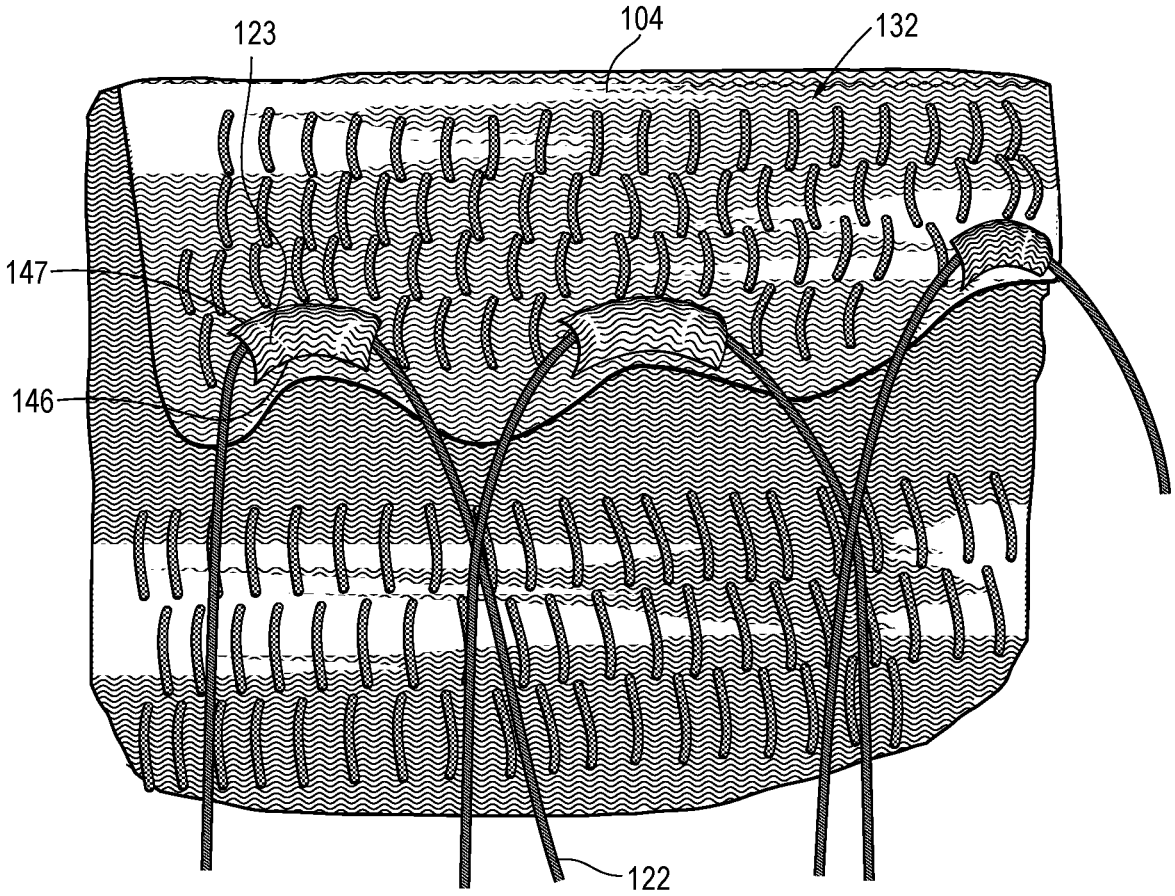
FIG. 3 is a photograph showing a close-up view of a knit anchor formed with a curved tubular knit structure in accordance with certain aspects of the present disclosure.
Figure 3A:
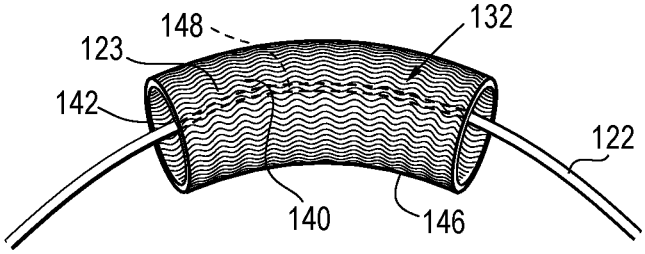
FIG. 3A is an illustration showing a close-up view of a knit anchor formed with a curved tubular knit structure in accordance with certain aspects of the present disclosure.

FIG. 3 is an illustration showing an example of knit anchors 123, where the knit anchors 123 are formed by a curved tubular knit structure. The curved tubular knit structure may be formed by a tubular knitting process where a knit layer formed on a first bed of the knitting machine remains separable from (e.g., not locked to) a knit layer formed on a second needle bed for a plurality of courses (as described in more detail below). For example, referring to FIG. 3A (showing a close-up view of one knit anchor 123) a first layer 140 of the anchor 123, which may define the exterior surface 132 of the knitted component 104, may be formed on a first needle bed (e.g., with a single-jersey or similar knit structure). A second layer 142 of the anchor 123, which may define an inner surface of the knitted component 104, may be formed on a second needle bed of a knitting machine (e.g., with a single-jersey or similar knit structure). The edges 146, 147 of the anchor 123 (which extend along the anchor's length) may be locations where a course at the end of the tubular knit structure (in the knitting direction) utilizes both needle beds, thus locking the first layer 140 and the second layer 142 together. In the resulting knitted component 104, a channel may be formed between the first layer 140 and the second layer 142 of the anchor 123, and the same channel may be used for receipt of the tensioning cable 122.

The curve of the anchor 123 may be advantageous for reducing the overall friction force caused by contact between the anchor 123 and the tensioning cable 122, and specifically between inward-facing surfaces of the knitted component 104 within the channel of the anchor 123 and an outer-diameter surface of the tensioning cable 122. In some embodiments, the radius of the anchor may be at least about 0.25 cm, such as at least about 0.5 cm, and such as at least 1 cm in certain exemplary embodiments. Different anchors 123 may have different radii, and the radius of each of the anchors 123 may be optimized based on the relative positions of the anchors 123 (e.g., to determine the position and direction-of-extension of the tensioning cable 122), the desired friction coefficient between the anchors 123 and the tensioning cables 122, etc.

Figure 4:
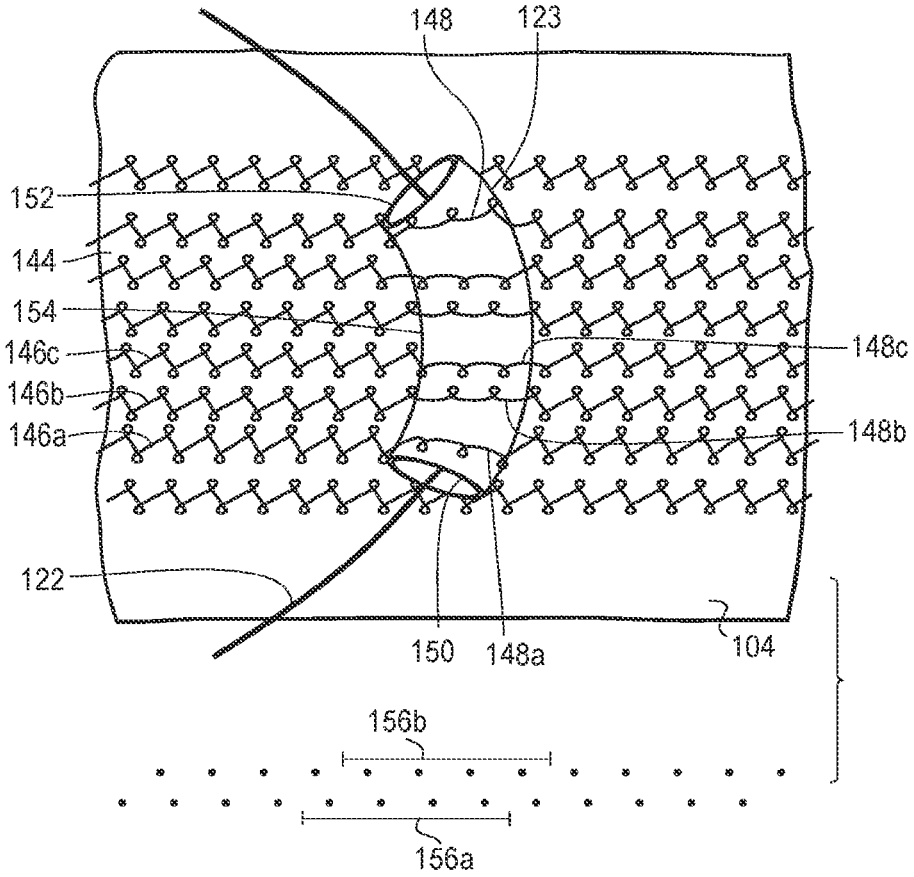
FIG. 4 is an illustration showing a knitting sequence for forming a knit anchor in accordance with certain aspects of the present disclosure.

FIG. 4 illustrates a knitting technique and sequence for forming the curved anchor 123. As shown, a base area 144 of the knitted component 104, which may be the knit portions surrounding the anchor 123, may be formed with portions of courses utilizing both a first needle bed (corresponding to top loops) and a second needle bed (corresponding to bottom loops). In the figure, the base area 144 is formed of a double-jersey knit structure (e.g., utilizing all needles on the top and bottom needle beds of the knitting machine), but this structure is shown as an example only and other two-bed knit structures are contemplated (e.g., an "edge-2" structure as is known in the art).

In contrast, the layers of the anchor 123 may be formed with a single-bed structure (or another structure forming a tubular construction, such as a more-advanced double-bed structure utilizing transfers). For example, a first course 146*a* extending across the anchor 123 may include a tubular portion 148*a* formed on a first needle bed of a knitting machine (e.g., a front bed). A second course 146*b* may include a tubular portion 148*b* on a second needle bed of the knitting machine (e.g., a back bed). The courses may alternate (or otherwise selectively switch) between utilizing the first needle bed and the second needle bed, and the loops on the first and second needle beds may remain detached for a selected period of time (e.g., a selected number of courses) to thereby form a tubular structure, as is known in the art.

To obtain the curve, the needles used to form the tubular portion 148 may change during knitting. For example, the first course 146*a* may have the tubular structure 148*a* at a first location, a second course 146*b* that is adjacent to (and potentially interlooped with) the first course 146*a* may have a tubular structure 148*b* at a second location, where the first location and the second location are offset on the needle bed and thus in the course-wise direction. This may be accomplished by utilizing a different set of consecutive needles on the needle bed to form the respective tubular structures 148*a*, 148*b*. For example, the section tubular structure 148*b* may be shifted one needle (or more) to the right during its respective formation relative to the first tubular structure 148*a*. More particularly, at a first end 150 of the anchor 123, a first series of needles 156*a* may be utilized to form the tubular knit structure of the knit anchor 123 (e.g., the first layer 140 and the second layer 142 shown in FIG. 3A). At a middle portion 154 of the knit anchor, a second series of needles 156*b* may be used to form the tubular knit structure, where the second series of needles 156*b* is offset relative to the first series of needles 156*a* (and, notably, the first series of needles 156*a* and the second series of needles 156*b* may have at least one needle in common). In other words, the tubular structure is "shifted" right on the needle bed of a knitting machine from the perspective of FIG. 4. Similarly, a third course 146*c* may have a tubular structure 148*c* that is further offset in the course-wise direction. This may continue until reaching the apex of the curve (which may occur at a midpoint of the middle portion 154 or other location) along the length of the knit anchor 123, when the tubular portions of the course 168 begin to shift back to the left. It is noted that "left" and "right" are used in this description for illustrative purposes only, and the directions could be switched, the curve could extend in multiple directions, multiple curves could be included, etc.

While the tubular knit structure forming the knit anchor 123 in FIG. 4 has a constant, or substantially constant width, the width could vary along the length of the knit anchor 123 by varying the number of needles of each (or at least one) needle bed of the knitting machine that form the tubular knit structure.

Figure 5:
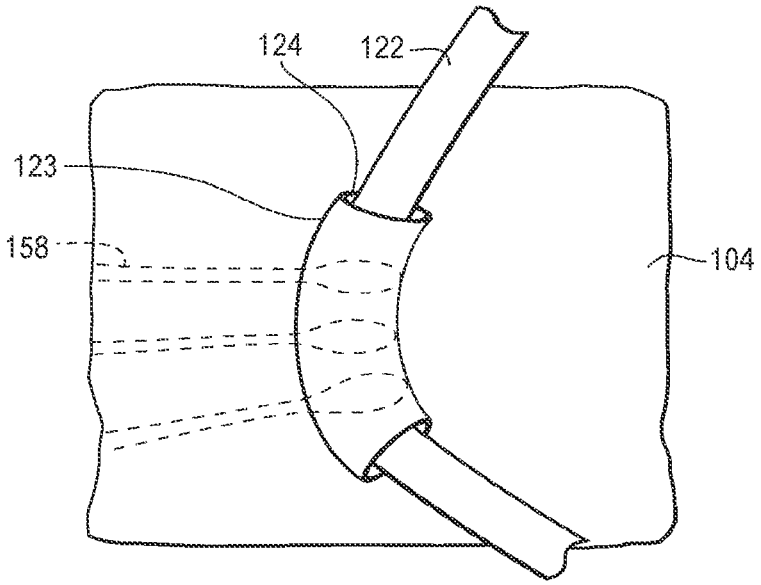
FIG. 5 is an illustration showing a knit anchor incorporating a tubular knit structure and inlaid strands in accordance with certain aspects of the present disclosure.

In some embodiments, additional elements (i.e., in addition to the tubular knit structure) may be included in the knitted component 104 to enhance the strength and durability of the knit anchor 123, and/or to distribute forces experienced at the knit anchor 123 (e.g., through communication with the tensioning cable 122). One example of such an element is at least one inlaid strand, such as the three inlaid strands 158 depicted in FIG. 5. In FIG. 5, the inlaid strands 158 extend around the outer perimeter of the channel 124 of the knit anchor 123, thereby forming a loop around the outer perimeter of the channel 124. The inlaid strands may be formed with a substantially inelastic material such that they do not substantially stretch when subjected to forces experienced during normal footwear use. This may provide reduced stretch of the layers of the knit anchor 123, decrease the potential for breakage of a knit anchor 123, etc. Further, the inlaid strands 158 may extend to particular locations of the knitted component 104 that are configured (e.g., sized, shaped, located, and have particular structural characteristics) to distributed forces received through the knit anchor 123 to locations that are strong and durable (e.g., locations beneath the foot, at the sole structure, and/or where particularly durable knit structures are located), locations where such forces will not irritate the foot of a wearer, etc. Particular methods of forming a knitting component with an inlaid strand that may be utilized in this embodiment are described in detail in U.S. patent application Ser. No. 13/048,527, filed Mar. 15, 2011, which is hereby incorporated by reference in its entirety.

Figure 6:
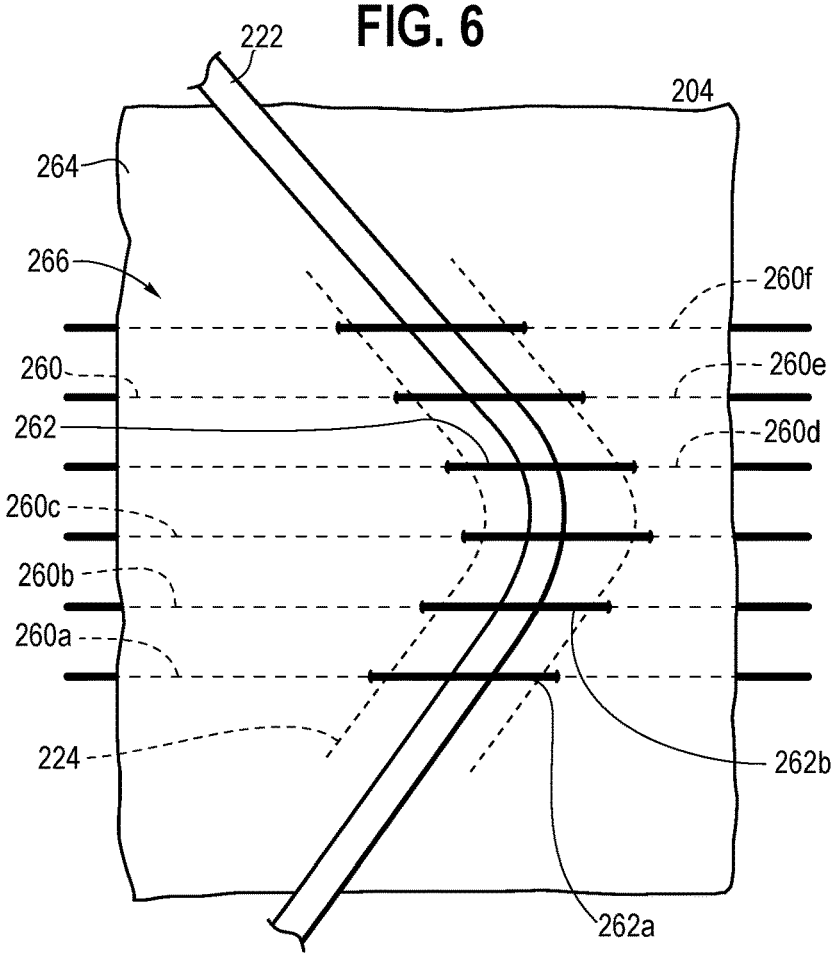
FIG. 6 is an illustration showing a knit anchor formed with exposed portions of inlaid strands incorporating a tensioning system with a knit anchor in accordance with certain aspects of the present disclosure.

A knit anchor could alternatively, or additionally, be formed of a knit structure other than a tubular knit structure. For example, FIG. 6 is an illustration showing a knit anchor that is formed by a plurality of inlaid strands 260 with corresponding exposed portions 262. There is no tubular knit structure in FIG. 6 (but in other embodiments, a tubular knit structure may be used in combination with inlaid strands). The inlaid strands 260 extend through a knit element 264, where the knit element 264 is defined by the plurality of intermeshed loops of the knitted component 204, and wherein the inlaid strands 260 of the knitted component 204 include at least one floating portion (e.g., a non-looped portion) that is inlaid within a course of the knit element 264 such that they are between courses of the knit element 264 (as described in U.S. patent application Ser. No. 13/048,527, which is incorporated by reference above).

The channel 224 of the knit anchor 223 in the depicted embodiment of FIG. 6 is defined as the pathway formed for receiving a tensioning cable 222 located between the exterior surface 266 of the knit element 264 (e.g., the surface defined by the intermeshed loops of the knit element 264) and the exposed portions 262 of the inlaid strands 260. The channel 224 can be utilized for any of the applications described with respect to this embodiment, such as for receipt of a tensioning cable 222 of an article of footwear or another article. Thus, when the tensioning cable 222 is deployed through the channel 224 of the knit anchor 223, the tensioning cable 222 extends between the exposed portions 262 of the inlaid strands 260 and the exterior surface 232 of the knitted component 204 (i.e., beneath the exposed portions 262 of the inlaid strands 260 but above the exterior surface 232 from the perspective of FIG. 6). To provide space for the tensioning cable 222, a certain amount of slack may be incorporated into the inlaid strands 260 during the knitting process. Such slack may not be required when the inlaid strands 260 are elastic (which is optional), and/or when the knit element 264 is elastic and/or compliant enough to receive the tensioning cable 222 without slack in the inlaid strands 260 (e.g., due to the bottom portion of the channel 224 stretching or otherwise adapting its geometry to accommodate the tensioning cable 222.

In FIG. 6, the channel 224 is curved, but a curve is optional. In other embodiments, the channel 224 may have any suitable shape. For example, the channel 224 may be linear (e.g., perpendicular relative to the course-wise direction), angled relative to the course-wise direction, may form a linear or curved zig-zagging shape, may have an irregular shape, etc.

To form the curved knit anchor 223 of FIG. 6, the exposed portions 262 of the inlaid strands 260 may be selectively exposed on the surface 266 of the knit element 264. For example, a first inlaid strand 260*a* may have an exposed portion 262*a* that is located at a first location along the course-wise direction (left-to-right in FIG. 6), the second inlaid strand 260*b* may have an exposed portion 262*b* that is located at a second location along the course-wise direction, where the first location and the second location are offset along the course-wise direction. Similarly, the third inlaid strand 260*c*, fourth inlaid strand 260*d*, fifth inlaid strand 260*e*, and sixth inlaid strand 260*f* may be selectively located on the exterior surface 232 of the knit element 264 such that the channel 224 is located and oriented as desired. While six inlaid strands 260 form the channel 224 in the depicted embodiment, more or less than six may be included.

Advantageously, by utilizing multiple inlaid strands 260 to form the channel 224, the distribution of forces throughout the knitted component 204 may be dispersed. For example, referring to FIG. 6, when a tension and/or lateral force is applied to the tensioning cable 222, a force will be transferred to the knitted component 204. Each of the inlaid strands 260 may absorb a portion of that force. The inlaid strands 260 may extend through the knitted component 204 in a desired directions to distribute that force in a particular manner. For example, each of the inlaid strands 260 may have an end that is fixed to a sole structure of an article of footwear to distribute the force to that sole structure. Since multiple inlaid strands 260 are used (in this embodiment), no single inlaid strand will absorb all of the force from the tensioning cable, but instead each of the inlaid strands 260 will absorb only a portion of that force (e.g., averaging out to ⅙ of the force per inlaid strand, though some may absorb more force than others). Advantageously, by distributing the forces among more than one inlaid strand, the chance of breakage of an inlaid strand may be reduced. Further, the tension within each of the inlaid strands 260 may be reduced relative to other embodiments, which may avoid concentrated "hot spots" that are prone to causing irritation to a wearer when the knitted component is incorporated into an article of footwear or apparel.

Figure 7:
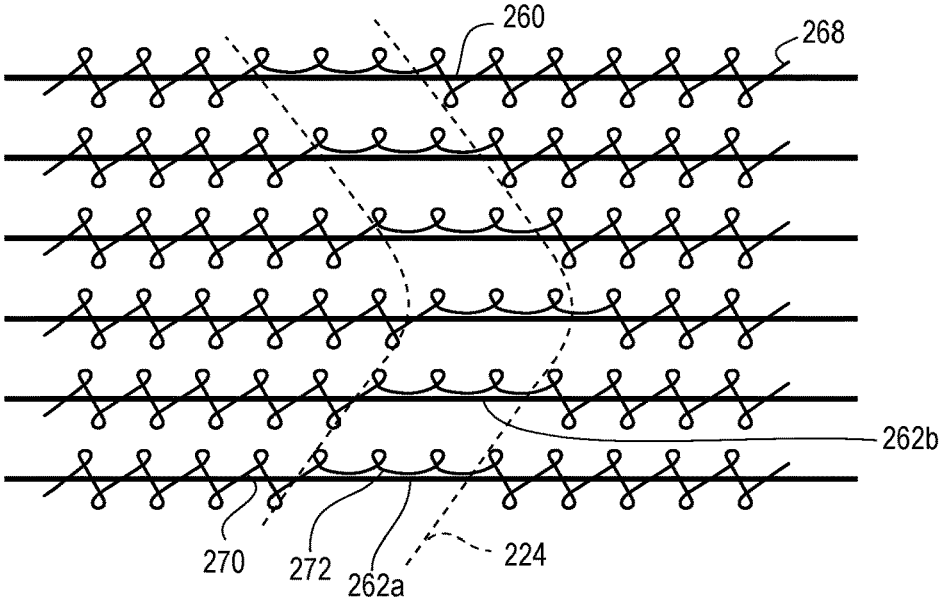
FIG. 7 is a knit diagram depicting a knitting sequence for forming a knit anchor formed with exposed portions of inlaid strands in accordance with certain aspects of the present disclosure.

FIG. 7 is a diagram illustrating a knitting sequence for forming the knit anchor of FIG. 6. The six courses of FIG. 7 may correspond with the six courses incorporating the six inlaid strands of FIG. 6. While no courses are located in-between those with inlaid strands in FIG. 7, it is contemplated that they may exist (with or without inlaid strands).

Referring to FIG. 7, a first course 268*a* may include a first knit structure 270 utilizing two needle beds surrounding a second knit structure 272 utilizing only one needle bed. The first inlaid strand 260*a* may be inlaid within the first course 268*a*. Since the first inlaid strand 260*a* is substantially surrounded by loops where the first knit structure 270 is located, it may remain between faces of the finished fabric in those locations (e.g., not exposed) when the knitting process is complete. In contrast, since loops exist on only one side of the first inlaid strand 260*a* where the second knit structure 272 is located, the first inlaid strand 260*a* may be exposed on the exterior surface 232 of the knit element 264 in this location. This exposed segment of the first inlaid strand 260*a* may correspond with the first exposed portion 262*a* shown in FIG. 6.

Similarly (and still referring to FIG. 7), the remaining courses 268 may include respective exposed portions. To form the curved shape of the knit anchor, the needles of the knitting machine used to form the second knit structure 272 (where the inlaid strands are exposed on a surface) may vary. For example, the series of needles used to form the exposed segment of the second inlaid strand 260*b* may be offset relative to the series of needles used to form the exposed segment of the first inlaid strand 260*a* (and, notably, these two series of needles may have at least one needle in common). The other courses may be formed similarly, and the second knit structure 272 may be selectively located along the course-wise direction to form the desired channel path.

While the exposed segments of the courses 268 are depicted as having the same length, this is not always the case. For example, one exposed segment may be longer than another. Additionally or alternatively, while each of the courses 268 includes one inlaid strand, more than one inlaid strand may be inlaid within at least one of the courses 268 to enhance the strength of the channel 224. Further, the inlaid strand of the courses 268 (or at least two of the courses) may be the same elongated strand (e.g., that is inlaid back-and-forth through the knit element 264), but in other embodiments, each of the inlaid strands 260 may be distinct strands.

Figure 8:
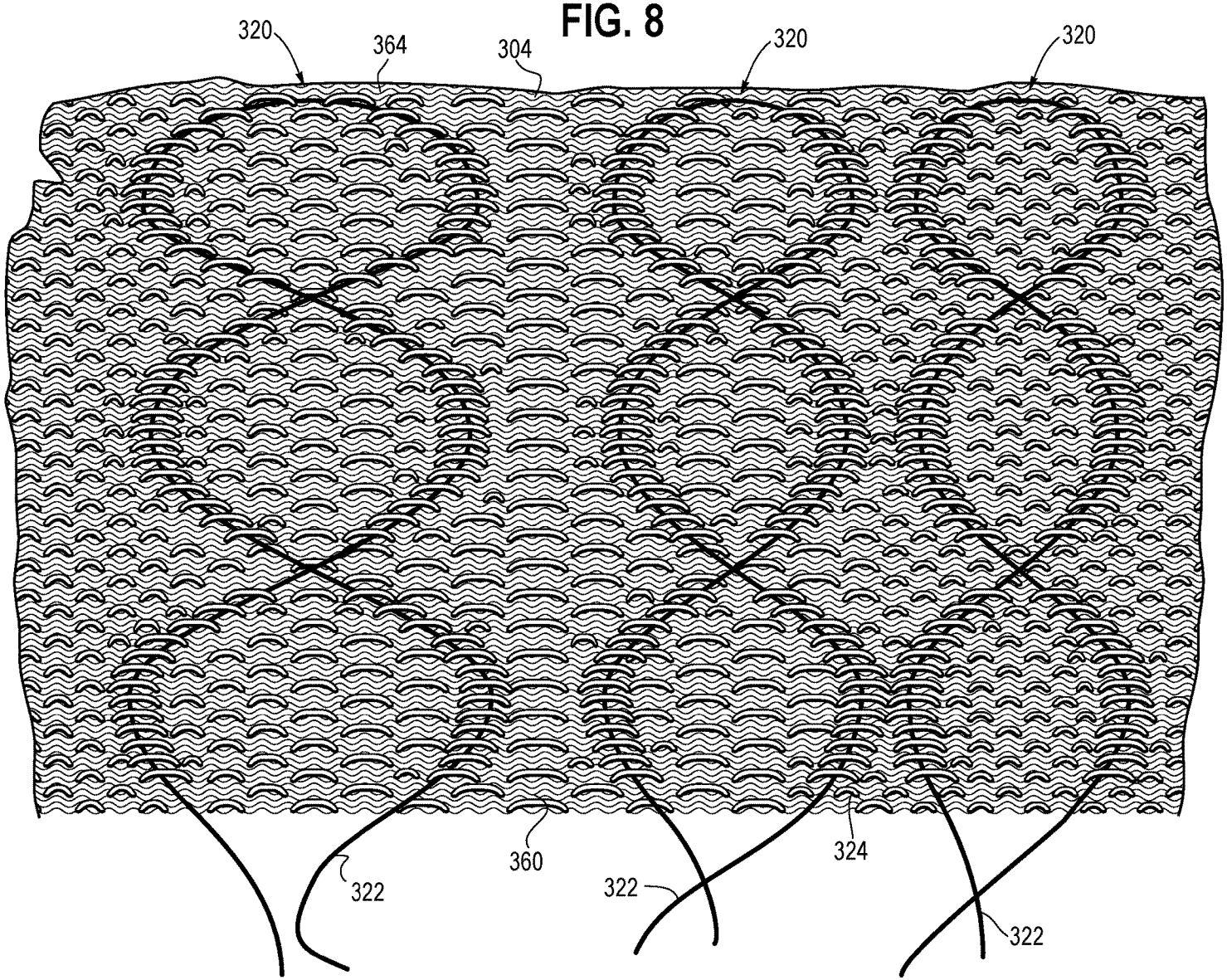
FIG. 8 is a photograph showing a knitted component with three tensioning systems in accordance with certain aspects of the present disclosure.

FIG. 8 is an illustration of a tensioning system 320 for an article, such as an article of apparel or an article of footwear. For example, the tensioning system 320 of may be included in the throat area of an article of footwear (where laces are typically located), in a waistband, sleeve, hood, collar, or other suitable area of an article of apparel where adjustment/tightening is desired, or within any other suitable article. The tensioning system may include two primary components: (1) a knitted component 304 (which may include the knit element 364 along with a plurality of inlaid strands 360, as shown) and (2) a tensioning cable 322, which may be deployed through a channel 324 of the knitted component 304 after (or during) the knitting process. As described in more detail below, applying tension to the tensioning cable 322 may cause the knitted component 304 to respond by adjusting its geometry to accomplish a variety of functions. For example, if the tensioning system 320 is incorporated into an article of footwear, applying tension to the tensioning cable 322 may cause the article of footwear to tighten around a foot. Similarly, if the tensioning system 320 is incorporated into an article of apparel, the article of apparel may adjust its geometry in response to applying a tension to the tensioning cable 322 to adjust tightness of the article of apparel around a body party or otherwise adjust the fit of the article of apparel. The article of FIG. 8 include three separate tensioning systems, and more or less than three may be included (e.g., it may be desirable to include only one in an article of footwear). In FIG. 8, the tensioning system 320 utilizes channels 324 formed by exposed portions of inlaid strands 360, similar to the embodiment of FIG. 6. Other embodiments are also contemplated. For example one or more curved tubular knit structures (e.g., as described with reference to FIG. 4) may be utilized to form channel(s) for receipt of the tensioning cable 322.

Figure 9:
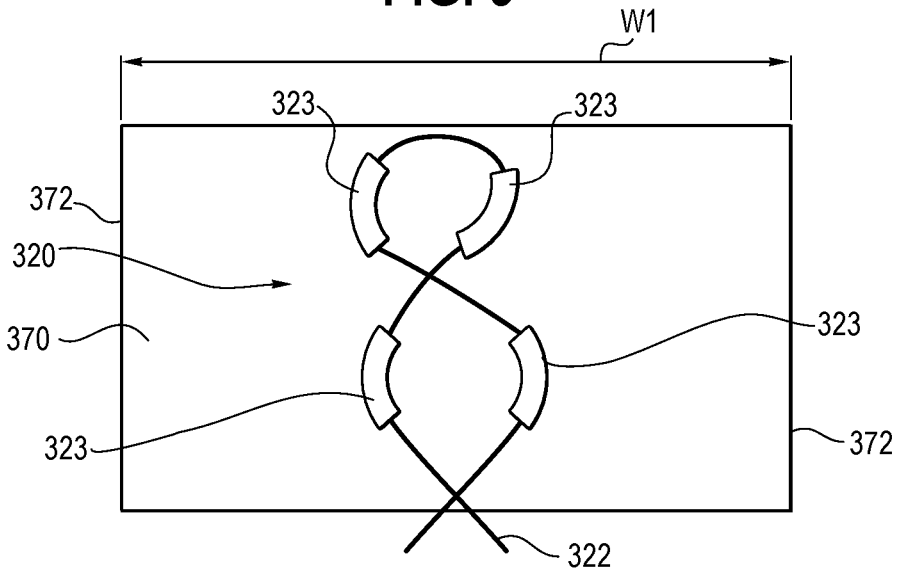
FIG. 9 and FIG. 10 are illustrations depicting the operation of a tensioning system upon application of tension to a tensioning cable in accordance with certain aspects of the present disclosure.
Figure 10:
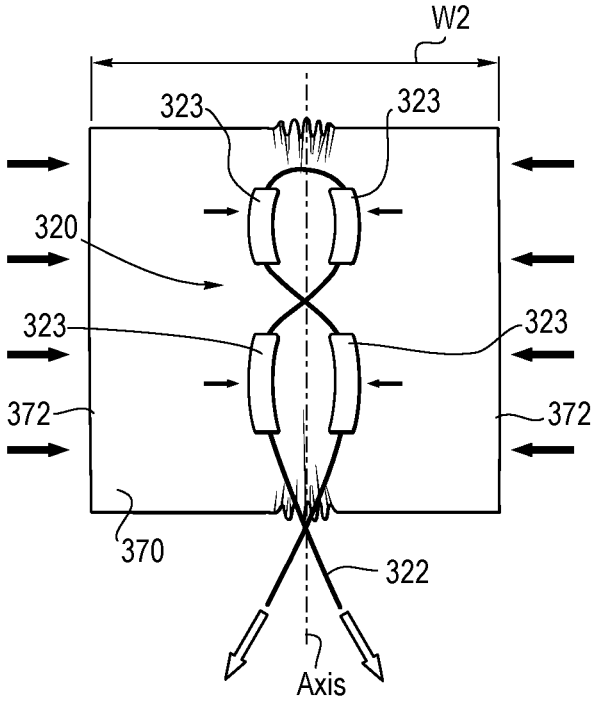

FIG. 9 and FIG. 10 are illustrations depicting the operation of the tensioning system 320 of FIG. 8. For example, in FIG. 9, the tensioning system 320 is shown in a default state where no external tension or force is applied to the tensioning cable 322. As shown, four knit anchors 323 are included (which may incorporate any of the knit or non-knit structures described herein (or other structures) along with the related aspects). In the default state of FIG. 9, the article (which may be a knitted component) has a first width W1. Upon application of a tension force T1 to at least one end of the tensioning cable 322, the tensioning cable 322 may force the knit anchors 323 towards an axis extending between the knit anchors 323 as shown in FIG. 10. Assuming no other forces are involved (e.g., an opposite force against the surface of a foot within an article of footwear, for example), the force upon the knit anchors 323 caused by tension in the tensioning cable 322 may decrease a dimension of the article, in this case the width (from W1 to W2).

While the overall width of the article in FIGS. 9-10 was adjusted due to the operation of the tensioning system 320, it is also contemplated that only certain portions of the article will change in geometry. For example, if the outer portion 370 is elastic, and the edges 372 are secured to another object, the tensioning system may pull the knit anchors 323 towards each other without changing the article's width. When this occurs, the outer portion 370 may be stretched to accommodate the change in size of the tensioning system 320. Similar aspects may be utilized to tighten or otherwise adjust the fit of an article of apparel or an upper of an article of footwear.

Figure 11:
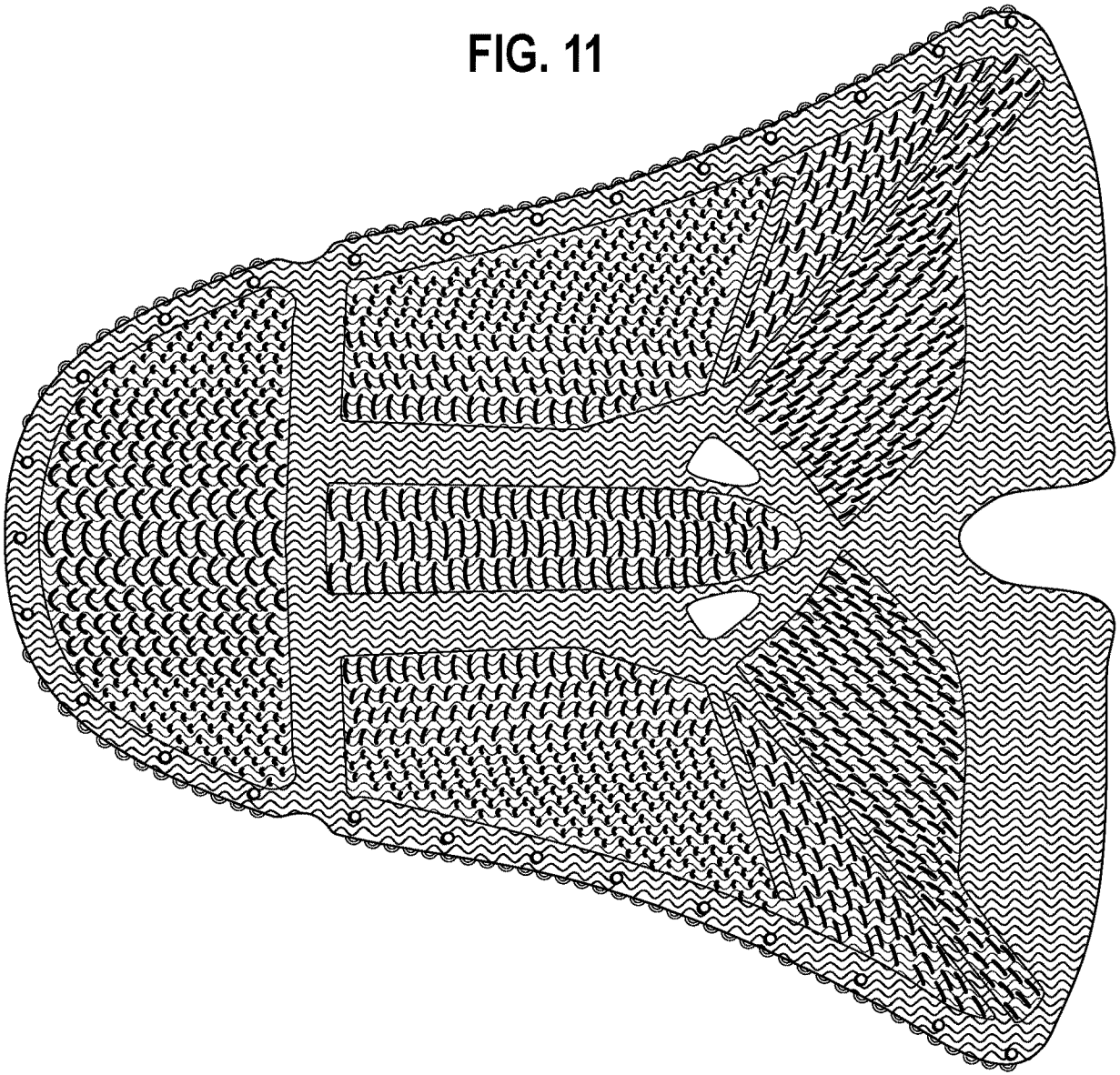
FIG. 11 is a photograph showing an upper for an article of footwear with multiple inlaid strands having exposed portions for selective utilization as knit anchor(s) in accordance with certain aspects of the present disclosure.

FIG. 11 is an illustration showing an upper for an article of footwear that incorporates inlaid strands in accordance with certain embodiments above, such as the embodiment of FIG. 6. Notably, many inlaid strands are included, and each inlaid strand includes many exposed portions. Advantageously, the exposed portions of the inlaid strands may be utilized to form one or more knit anchors. Further, it is contemplated that the particular exposed portions may be selectable among many, or even all, of the exposed portions, which may provide a level of customization regarding how a tensioning system is implemented. For example, if the tensioning system is simply a shoelace, a user may select which exposed portions of the inlaid strands are used as an interface with that shoelace. Similarly, if the tensioning system is more advanced, it may be adjusted to select particular exposed portions as forming a knit anchor based on user preference, size, function (e.g., particular sport), etc.

Figure 12:
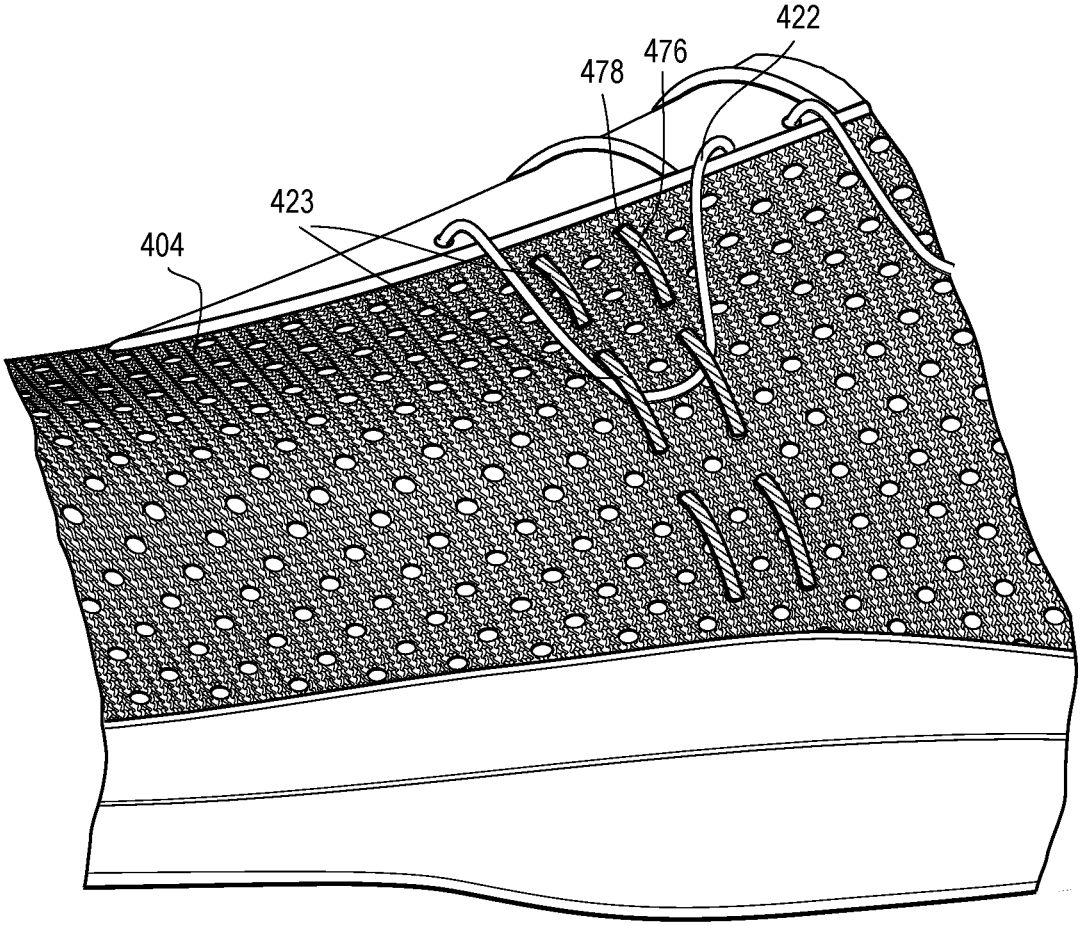
FIG. 12 is a photograph showing a non-knit anchor for use with a tensioning system in accordance with certain aspects of the present disclosure.

FIG. 12 is an illustration showing an alternative embodiment of an anchor 423 (with a tensioning cable 422 extending therethrough), which may be utilized with any of the embodiments described above. The primary difference between the anchor 423 and the above-described knit anchors is that the anchor 423 is formed via strands 476 that are incorporated into the article of footwear after the knitted component 404 is formed. In other words, the anchor 423 is not part of the knitted component 404 (as it is not formed on the knitting machine or via knit), and thus it is not a "knit anchor." Instead, the strands 476 are deployed through openings 478 of the knitted component 404 during a post-knitting assembly step. In this embodiment, the anchor 423 is formed with two strands 476, but more or less than two strands may be included. Further, it is contemplated that a separate friction-reducing component may be included (not shown), such as a pulley, a metal orifice with a smooth, friction-reducing surface, etc. (and such elements could also be included with the knit anchors described above).

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. An upper for an article of footwear, comprising:
- an adjustable tensioning cable;
- a knitted component forming at least a portion of an exterior surface of the upper, wherein the knitted component comprises a knit anchor having a channel for receiving the adjustable tensioning cable; and
- an inlaid strand within the knitted component,
- wherein the inlaid strand extends around a perimeter of the channel of the knit anchor,
- wherein the adjustable tensioning cable extends through the channel and through a loop formed by the inlaid strand, and
- wherein the channel of the knit anchor extends along an arc oriented towards a throat area of the upper,
- wherein the knit anchor is formed with a curved tubular knit structure of the knitted component.

2. The upper of claim 1, wherein the curved tubular knit structure comprises a first layer and a second layer, and wherein the channel of the knit anchor is defined between the first layer and the second layer.

3. The upper of claim 1, wherein the inlaid strand is substantially inelastic.

4. The upper of claim 1, wherein the adjustable tensioning cable extends at least partially across a throat area of the knitted component such that it pulls a lateral side of the throat area towards a medial side of the throat area when the adjustable tensioning cable is tightened.

5. The upper of claim 1, wherein the adjustable tensioning cable is slidable relative to the knit anchor.

6. The upper of claim 1, wherein the arc comprises a radius of at least 1 cm.

7. An article of footwear with a tensioning system, comprising:
- an upper, comprising:
  - an adjustable tensioning cable;
  - a knitted component forming at least a portion of an exterior surface of the upper, wherein the knitted component comprises a knit anchor having a channel for receiving the adjustable tensioning cable; and
  - an inlaid strand within the knitted component,
  - wherein the inlaid strand extends around a perimeter of the channel of the knit anchor,
  - wherein the adjustable tensioning cable extends through the channel and through a loop formed by the inlaid strand, and
  - wherein the channel of the knit anchor extends along an arc oriented towards a throat area of the upper; and
- a sole structure,
- wherein the knit anchor is formed with a curved tubular knit structure of the knitted component.

8. The article of footwear of claim 7, wherein the knit anchor is formed with a curved tubular knit structure of the knitted component, wherein the curved tubular knit structure comprises a first layer and a second layer, and wherein the channel of the knit anchor is defined between the first layer and the second layer.

9. The tensioning system of claim 7, wherein the inlaid strand is substantially inelastic.

* * * * *